US008064628B2

(12) United States Patent
Bailis et al.

(10) Patent No.: US 8,064,628 B2
(45) Date of Patent: Nov. 22, 2011

(54) PORTABLE BOX FOR CARRYING ITEMS

(75) Inventors: Robert Bailis, Cary, NC (US); Tom Butler, Raleigh, NC (US); Brian Flynn, Apex, NC (US); Alan Kinlaw, Greensboro, NC (US); Ian Jester, Wilmington, NC (US); Carl Taylor, Cary, NC (US)

(73) Assignee: North Carolina State University, Raleigh, NC (US)

( * ) Notice: Subject to any disclaimer, the term of this patent is extended or adjusted under 35 U.S.C. 154(b) by 545 days.

(21) Appl. No.: 12/323,643

(22) Filed: Nov. 26, 2008

(65) Prior Publication Data

US 2009/0139990 A1 Jun. 4, 2009

Related U.S. Application Data

(60) Provisional application No. 60/992,139, filed on Dec. 4, 2007.

(51) Int. Cl.
*B65D 51/24* (2006.01)
*B65D 85/00* (2006.01)
*H04R 1/02* (2006.01)

(52) U.S. Cl. ..... 381/386; 220/212; 206/326; 381/334

(58) Field of Classification Search ..... 381/337–423; 181/148–199; 220/212; 206/326
See application file for complete search history.

*Primary Examiner* — Jarrett Stark
*Assistant Examiner* — Lawrence Tynes, Jr.
(74) *Attorney, Agent, or Firm* — Ward and Smith, P.A.

(57) ABSTRACT

A telescoping box includes a lid. The upper section of the box includes lids which are frictionally engagable therewith. The lids include speaker assemblies as part of each lid. The lids are removable and include connection points for audio signal sources such as MP3 players.

23 Claims, 7 Drawing Sheets

PORTABLE BOX FOR CARRYING ITEMS

CROSS-REFERENCE TO RELATED APPLICATIONS

This application is related to U.S. Provisional Patent Application Ser. No. 60/992,139, filed Dec. 4, 2007; the disclosure of which is incorporated by reference in its entirety.

BACKGROUND OF THE INVENTION

1. Field of the Invention

This invention relates to a portable box for carrying items. More particularly, the invention relates to a portable box for carrying items such as foldable chairs, which is adjustable in size and includes integrated speakers connectable to sources of audio content such as MP3 players, for allowing playing of such audio content in recreational environments.

2. Discussion of Prior Art

Folding chairs have become extremely popular for use in outdoor activities in a number of different forms. More specifically, at weekend family sporting events many families can be seen carrying folding chairs to and from the events, and using the chairs for seating during the events on the sidelines. Similarly, such chairs are also used by campers, in picnic environments and virtually any other outdoor activity in which a user may wish to have a seating surface available.

Current folding chairs designs generally involve chairs which have a foldable frame and multiple fabric or canvas panels making up back, arm and seat surfaces thereof. Such chairs are typically easily transported in sacks which are in many cases made up of a bag body of sufficient volume to have the chair in folded condition inserted therein, as well as other accessories such as an attachable umbrella which attaches to a frame member of the chair, for example, to provide shade on sunny days. Further, such bags or sacks typically also include an attached strap to facilitate carrying of the folding chair on a shoulder.

As a result of an increase in outdoor activities, use of devices such as MP3 players have become quite popular, for example, with outdoor enthusiasts who exercise through jogging, and other like activities. One advantage of such MP3 devices is that they are light and easily carried without hindering activities such as jogging, biking and other physical activities. However, such MP3 devices can generally be used in an outdoor environment by only one person, and the audio content of the devices such as music, cannot be shared with others in a social setting where a multitude of people would be gathered in a relaxed environment using the aforementioned folding chairs, such as in camping.

One prior art attempt to remedy this problem provides a folding chair that comes with a portable stereo system. Such a system offers people a different approach on how a folding chair can be utilized providing entertainment enjoyment in one device in order to reduce traveling difficulties. However, such a device suffers from the disadvantage that as a result of containing a complete portable stereo system, the chair is heavy and difficult to carry and requires a multitude of complex components, such as a mini boom box, battery pack, audio frequency receiver, audio frequency wire and speakers.

Accordingly, it is desirable to provide a device and system allowing comfortable transport of items such as folding chairs for use in outdoor environments which also allows sharing of content on MP3 players, such as music.

BRIEF SUMMARY OF THE INVENTION

The present invention provides a portable box for carrying items. More specifically, the portable box in accordance with the invention is adapted in particular, for carrying items such as folding chairs. Aspects of the invention may include a container having at least one open end and a lid securable to close the open end. A speaker is made part of the lid. A connection is provided on the lid to connect an external source of audio content to the speaker.

In a more specific embodiment, a first sleeve and a second sleeve each define a conduit open at each end. The first and second sleeves are frictionally slidably engaged to define a variable length conduit, having open ends at either end thereof. A first lid securing member is secured at a first open end and a second lid securing member secured at a second open end. The first and second lid securing members have an opening for receiving respective first and second lids therein. The first and second lids and lid receiving members are configured for rotatably frictionally engaging the lids for closing and opening thereof. At least one speaker is secured as part of at least one of the first and second lids. A source of power is provided for the speaker for driving the speaker. A connection, i.e., jack input, is provided and is connected to the speaker for connecting an audio content source to the speaker (s), such as a MP3 player.

In a preferred aspect, the speaker is a flat panel speaker having no cone and generally consisting of a membrane and a distributed mode actuator (DMA) electronic component such as is available commercially from NXT. An exemplary speaker arrangement includes two speakers, one at each end of the box. A power source such as a solar panel with super capacitors and combination of batteries, or batteries alone, is used to power the electronic component for the speaker.

In a yet still further variant of the invention, the first and second sleeves are made of cellulosic material which has been made water resistant including, through decorative laminations on the outer surfaces thereof. The rigid caps and lid securing members are made of plastic material, optionally, polypropylene, foamed plastic or cellular plastic.

In a specific configuration, the first and second lid securing members have cutout regions and tabs adjacent to cutout regions. The first and second lids also have tabs for being received in the cutout regions and retained on the first and second lid securing members through rotation thereof to have the tabs received under the securing member tabs in a recess defined by the tabs of the lid securing member.

These and other advantages and features that characterize the invention are set forth in the claims annexed hereto and forming a further part hereof. However, for a better understanding of the invention, and of the advantages and objectives attained through its use, reference should be made to the Drawings, and to the accompanying descriptive matter, in which there are described exemplary embodiments of the invention.

DETAILED DESCRIPTION OF THE INVENTION

The device in accordance with the invention is a telescoping box having at least one lid and preferably two removable lids, one at each end. The outer end sections of the box include two respective plastic end support rings or members which serve as rigid caps to each outer end of the sleeves. The lower section sleeve of the box is slightly larger than the upper section. The pieces slide together, and are held by friction, so that the box can be maintained stable at any length of extension. At either end of the assembled box, a lid assembly is attached to the end support ring with a lid that rotates 45 degrees to open or close the box. The lid can be rotated in either direction for opening or closing. In one configuration the box is configured as a container for a foldable chair and includes a loudspeaker in each lid compatible for connection with an MP3 player or like device.

The loudspeaker is optionally powered by batteries, solar cells and/or super capacitors, and is preferably made as a coneless type of system using a substrate to generate sound. This can be done by attaching a distributed mode actuator (DMA) electronic component on a substrate to cause the substrate to generate sound. Such components are commercially available from NXT as described on its webpage at www.nxtsound.com at "Special Applications." More, specifically, such a component includes a rugged transducer developed to automotive test standards which can be integrated on a number of different types of substrates, including but not limited to substrates like cardboard or plastic.

In an exemplary embodiment, the box telescopes so that it can be changed in size and allows advantages in loading and storage, as well as providing the ability to size the box downward to fit the item inside. An additional advantage is that items therein can be exposed by collapsing the box when loading and unloading, making such actions easier to accomplish. Functionally, the lid has no threads so it cannot be over tightened. It can be turned in either direction to open or close, and tactile feedback is provided when the lid snaps closed as will become more evident from the following detailed discussion. As already noted the lid also contains a loudspeaker and by having lids at either end, items that would normally be the bottom of the box can be easily removed by opening the lid at the bottom.

Figure 1:
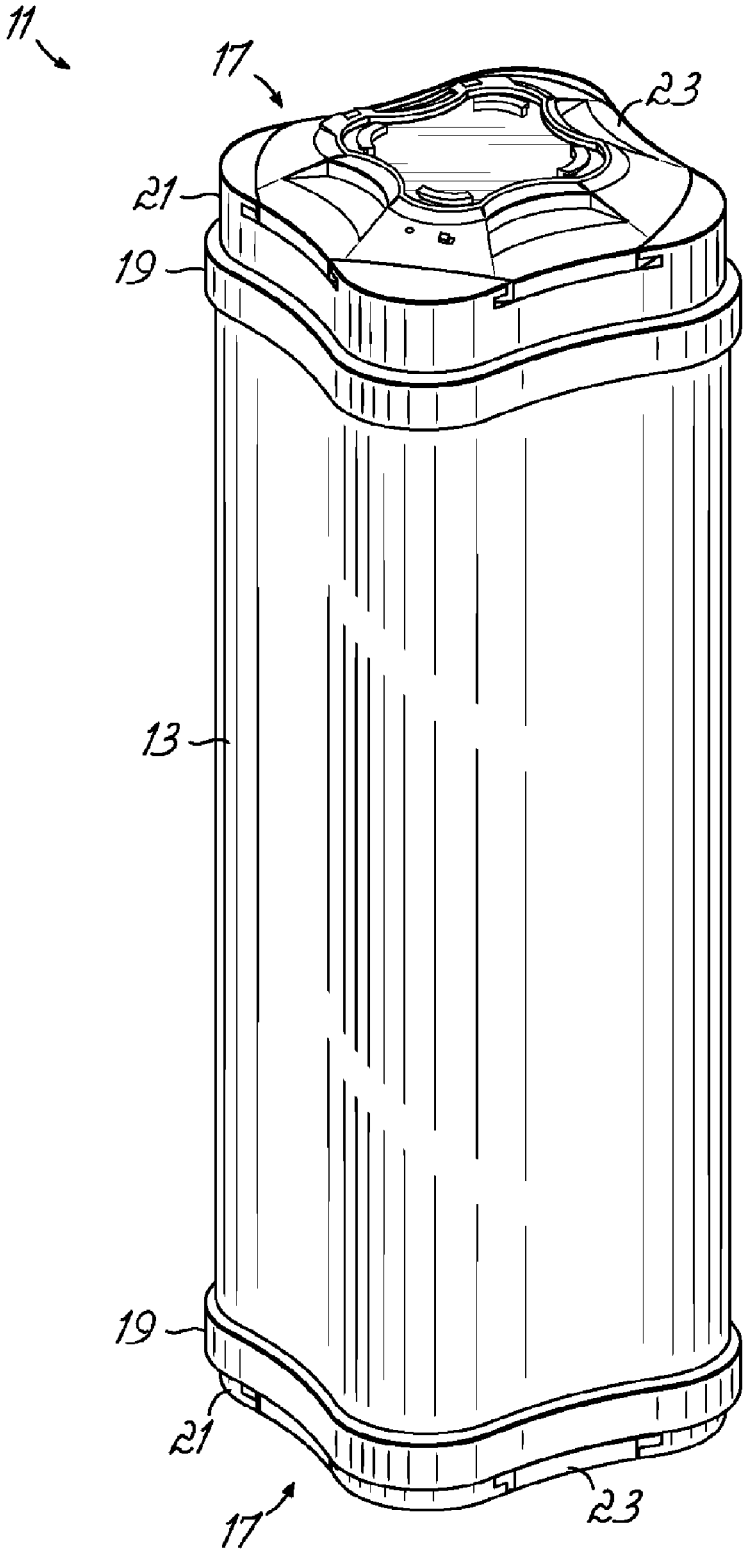
FIG. 1 is a perspective view of the box in a collapsed configuration with one sleeve fully received within a second sleeve in accordance with one aspect of the invention.
Figure 2:
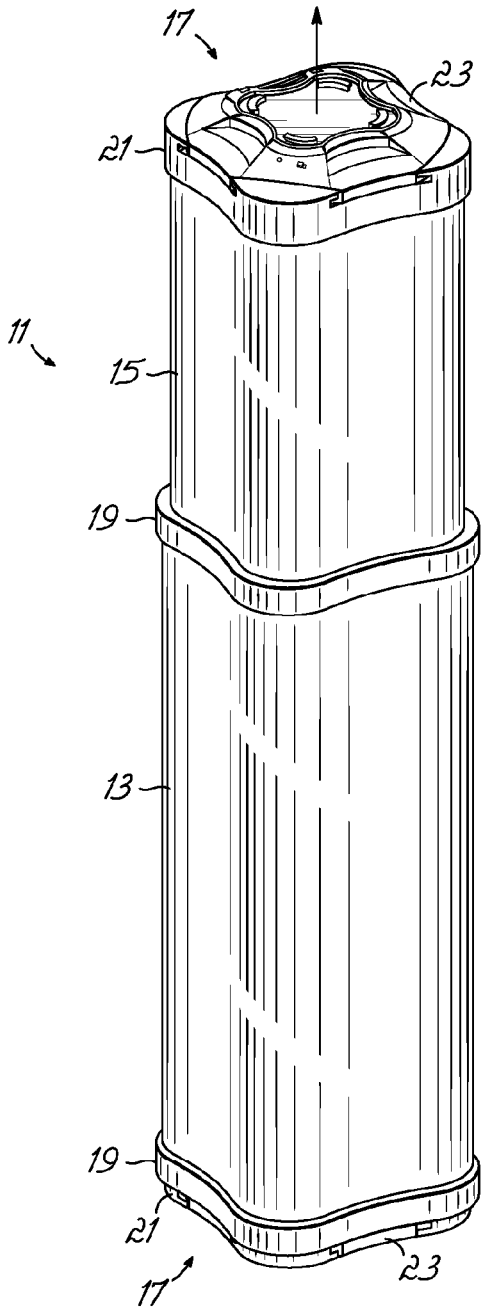
FIG. 2 is a perspective view of the box in a partially extended form.
Figure 3:
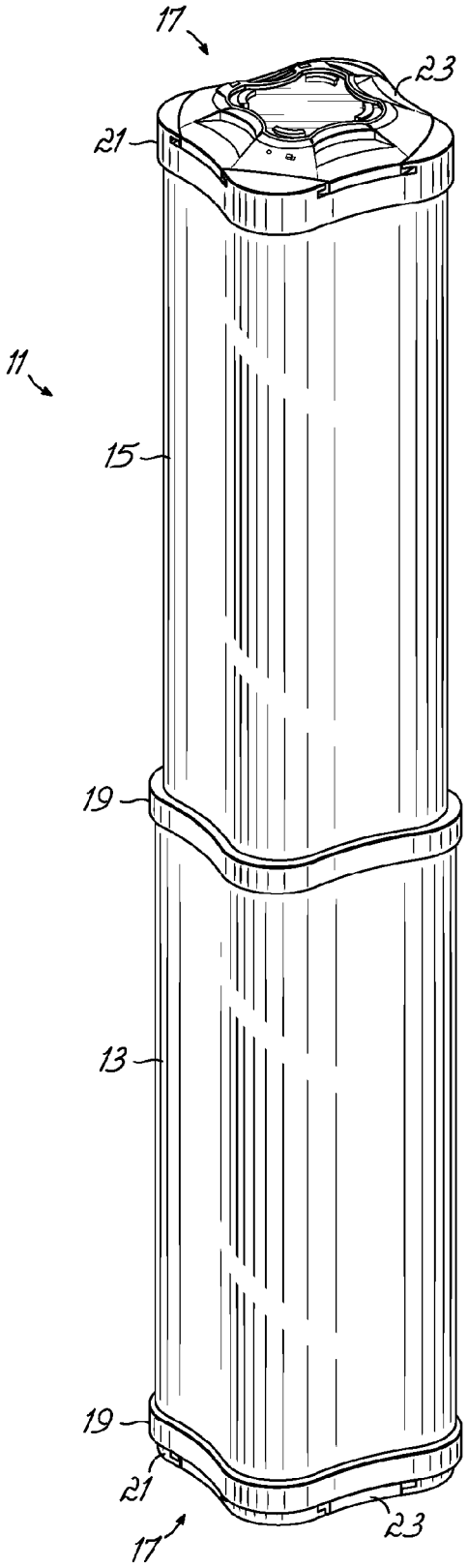
FIG. 3 is a perspective view of the box in a fully extended form.

While the principles of this invention do not limit its form or application, one embodiment capitalizes on the structure available through the system exemplified in FIGS. 1-3. FIG. 1 generally shows a box 11 including an outer sleeve 13 and as shown in FIGS. 2 and 3 an inner sleeve 15 which is sized slightly smaller than the outer sleeve 13. End assemblies 17 are made up of lid securing members 21 and lids 23 which sit up on top of rigid end caps 19 which surround the cardboard ends of the box sleeves 13 and 15.

Figure 4:
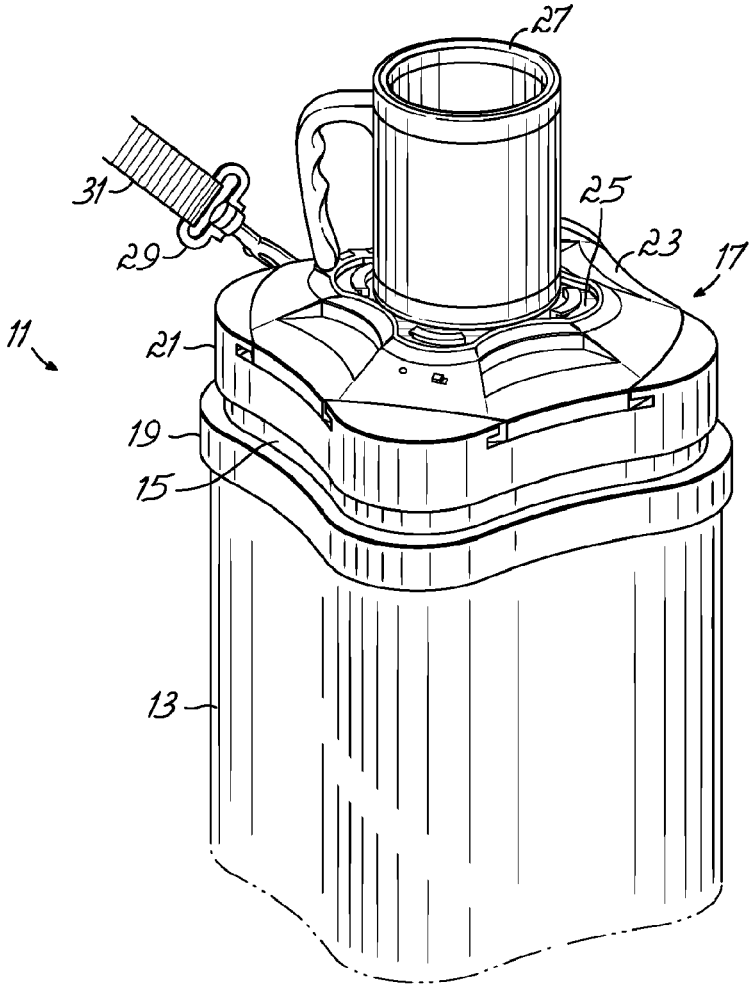
FIG. 4 is a partial perspective view of the box in accordance with the invention, with a lid secured thereon, and including a surface for supporting items such as cups.

FIG. 4 shows a partial view in perspective of an assembled box 11 in accordance with the invention. The rigid caps 19 at the end of the sleeves have supported thereon the end cap assemblies 17 which include the securing members 21 and lid 23. The lid 23 can be configured to include an upper surface 25, as shown, of a form to support items such as cup 27. The box 11 can also include as part of the rigid cap assembly 17, or of the end caps 19, a strap 31 connectable through conventional clips 29 for ease of carrying the box 11.

Figure 5:
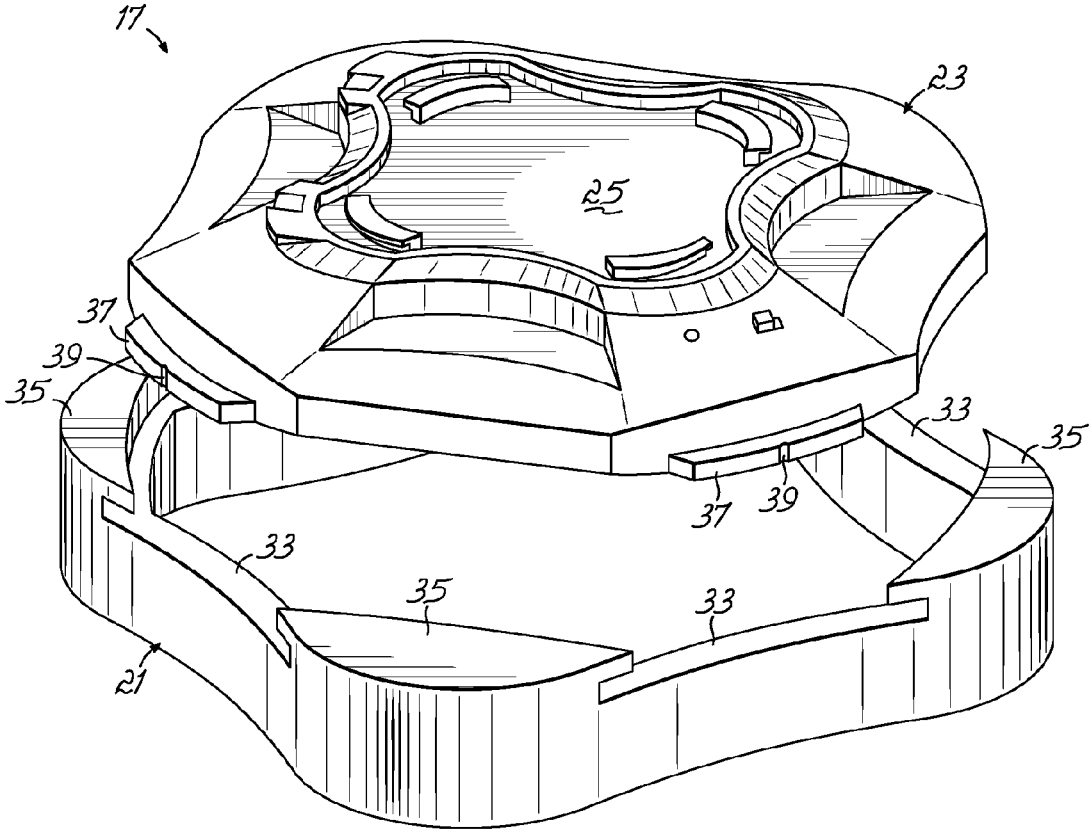
FIG. 5 illustrates a lid holding member and a lid therefor, shown in disassembled condition.

FIG. 5 shows a lid securing member 21 with a lid 23 separated therefrom of the type which also includes the support surface 25 previously described. Recesses 33 are provided on the lid holder 21 which also include lid securing member tab 35 with a space defined below the securing member tab 35. The lid 23 includes lid tabs 37, which also include cutout region 39 to provide secure engagement as will be further described herein.

Figure 6:
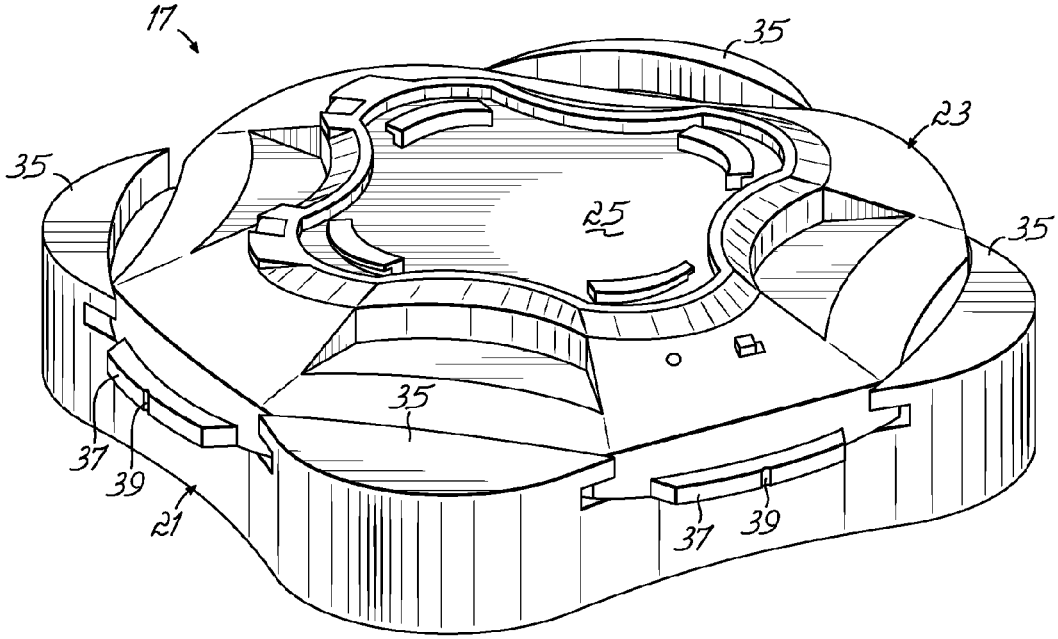
FIG. 6 is a view as in FIG. 5 but showing the lid received within the lid receiving member, but in a loose fitting condition.

FIG. 6 illustrates the lid 23 received within the lid securing member 21 including the lid tab 37 sitting on the lid holder 21 in the recesses 33 thereof.

Figure 7:
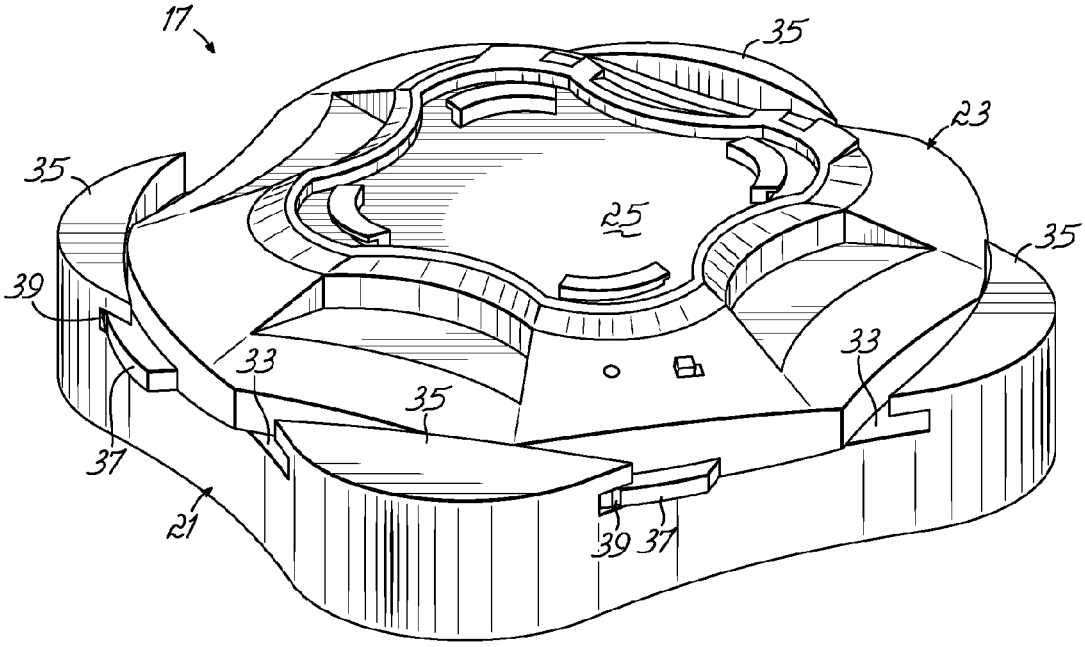
FIG. 7 is a view as in FIG. 6 but showing the lid partially engaged.

FIG. 7 illustrates a rotation of the lid 23 such that the lid tab 37 begins to be received within a recess defined by securing member tab 35. As may be appreciated by those of ordinary skill in the art, the rotation can proceed in either a leftward or rightward direction.

Figure 8:
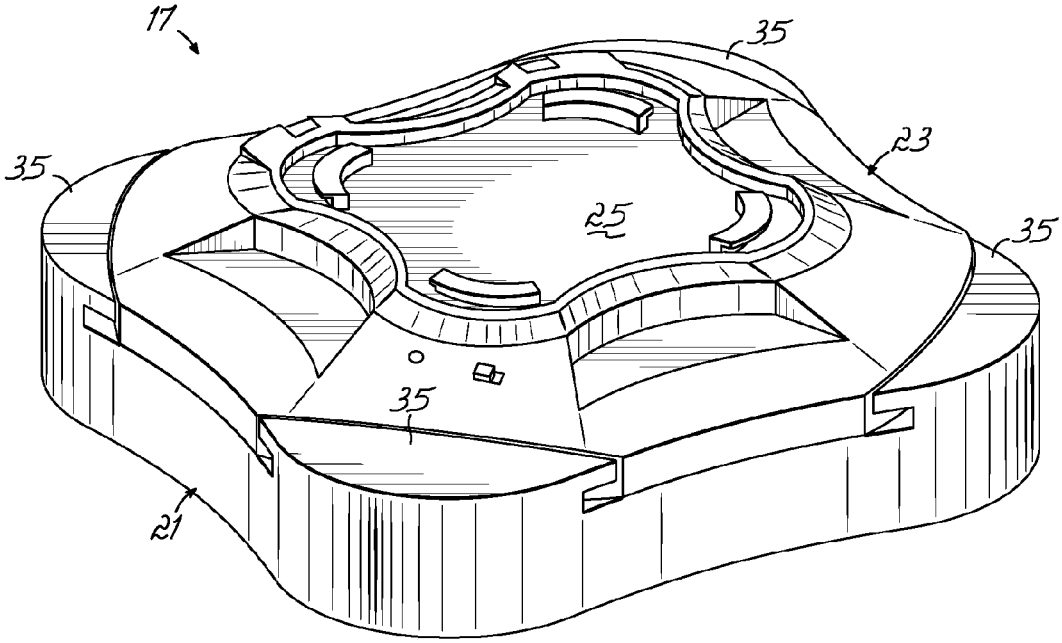
FIG. 8 is a view as in FIG. 6 showing the lid in a fully engaged condition.

FIG. 8 illustrates a fully assembled lid securing member 21 with a lid 23, as assembly 17. In order to provide secure tactile feel, there is a projection located within a wall of the recesses in which the tabs 37 are received which engages with cutout region 39. The projection can be made by appropriate molding of the lid holder 21 or by a cutout with insertion of a section of an elastomeric material such as a portion of an o-ring. In this form the securing engagement point is felt by the user closing the lid of the box.

Figure 9:
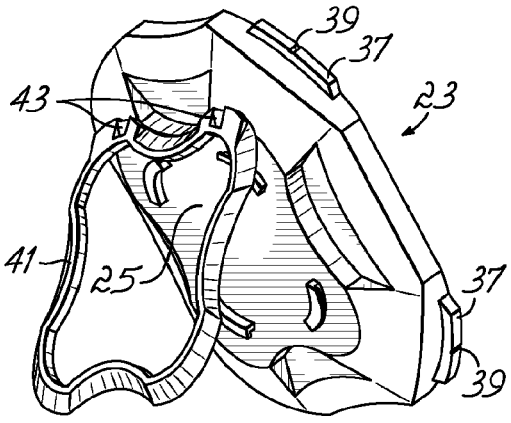
FIG. 9 shows a lid with a support member for use as a speaker.

FIG. 9 illustrates a lid assembly in accordance with the invention including a stand which may pivot away from the lid top at a pivot point 43 for use as a speaker.

Figure 10:
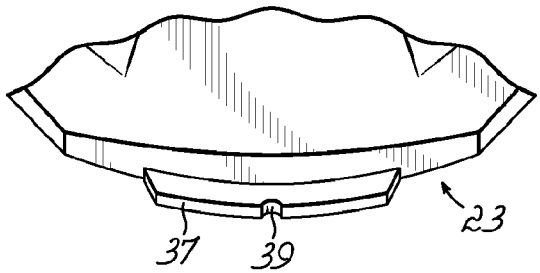
FIG. 10 shows in detail a lid extension having a lid extension recess or cutout for secure engagement in a closed position.

FIG. 10 illustrates in greater detail the lid recess or cutout 39 on the lid projection 37.

Figure 11:
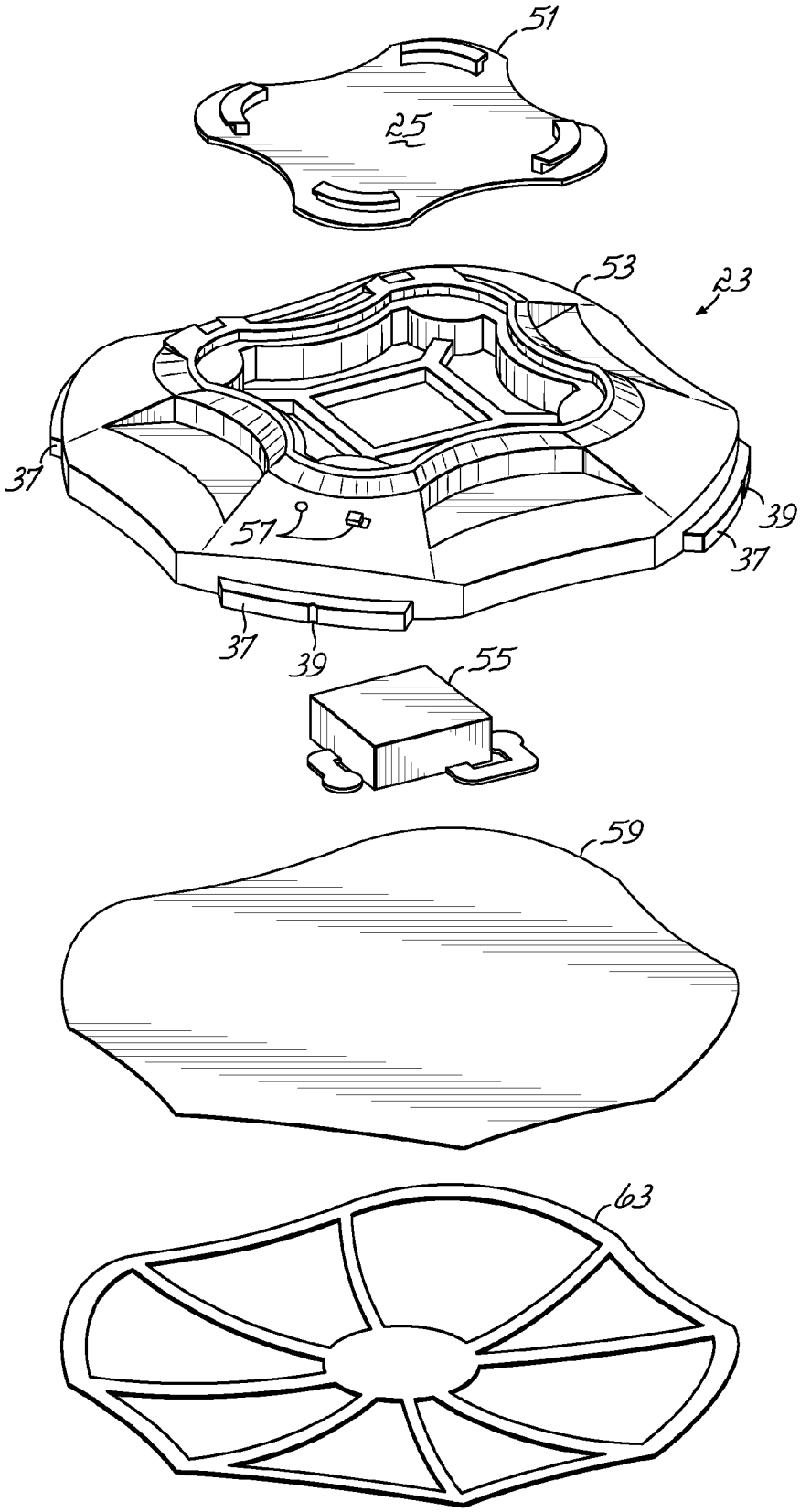
FIG. 11 is an exploded view of an exemplary embodiment of a lid and speaker arrangement in accordance with the invention.
Figure 12:
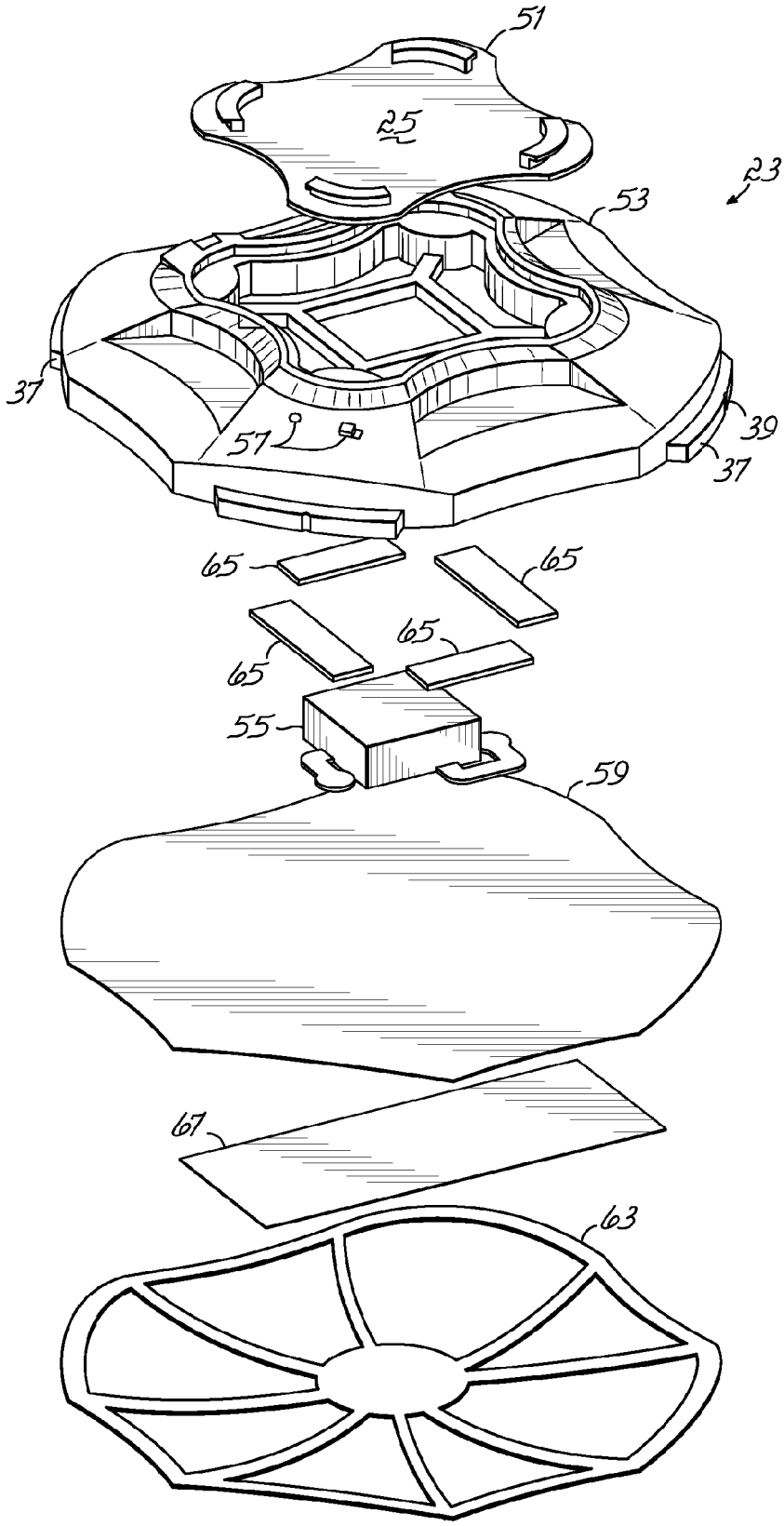
FIG. 12 is an exploded view of an alternative exemplary embodiment of a lid and speaker arrangement in accordance with the invention.

In order to describe exemplary speaker assemblies as part of the lids in accordance with the invention reference is made to FIGS. 11 and 12. More specifically, FIG. 11 illustrates in exploded form one exemplary embodiment of the invention including a speaker back 51 which is shaped to include the support surface 25. The speaker back is received in a speaker enclosure 53 making up part of the lid 23 which in turn includes a switch and connection port 57 for connection through conventional means to an MP3 player or like devices to provide signals to a speaker made of part of the assembly making up the lid 23. A flat panel speaker module 55 is received within a recess in speaker enclosure 53 and is conventional in nature such as is available commercially from NXT as a distributed mode actuator (DMA) electronic component which includes a rugged transducer, as previously discussed, for use in assembling the speaker thereof. The speaker module 55 in this embodiment includes an intergrated battery holder and is connectable in a conventional manner to a speaker substrate 59 assembled in cooperation with a grill 63. The substrate can be a cardboard panel, plastic panel or other suitable material as will be apparent to those of ordinary skill.

In the embodiment of FIG. 12, super capacitors 65 are provided connectable in a conventional manner to the speaker module 55 of the type described previously, which may or may not include an intergrated battery holder as an optional feature thereof. In addition to the speaker substrate 59, a thin flexible solar panel is connected in a conventional manner for charging the super capacitors 65. In all other aspects, the embodiment of FIG. 12 is similar to that of FIG. 11.

In yet another exemplary modification, an air outlet can be place at the bottom of the narrower sleeve and the sleeves sized to be used an air pump directing air through the outlet as a result of expanding and collapsing sliding action.

While the present invention has been illustrated by a description of various embodiments and while these embodiments have been described in considerable detail, it is not the intention of the Applicants to restrict, or any way limit, the scope of the appended claims to such detail. The invention in its broadest aspects is therefore not limited to the specific details, representative components and methods, and illustrative example shown and described. Accordingly, departures may be made from such details without departing from the spirit or scope of Applicants' general inventive concept.

What is claimed:

1. A portable box for carrying items, comprising:

a sleeve defining a container open at least at one end;

a lid securable at said at least one open end for closing the container;

a speaker secured as part of said lid; and a connection arranged for having an audio signal source connected thereto for connection to the speaker.

2. The portable box according to claim 1, wherein said speaker is constructed as a flat panel portable speaker.

3. The portable box according to claim 1, wherein said power source comprises a solar panel and associated capacitors.

4. The portable box according to claim 3, further comprising said capacitors connected to said solar panel for being charged thereby, and connected for providing power to said at least one speaker.

5. The portable box according to claim 1, wherein said power source comprises at least one battery.

6. The portable box according to claim 1, sized to accommodate a folding chair.

7. A portable box for carrying items, comprising:

a first sleeve defining a conduit;

a second sleeve defining a conduit, said first and second sleeves being frictionally slidably engaged with each other to define a variable length conduit, and said conduit having a first open end and a second open end;

a first lid securing member secured at said first open end and a second lid securing member secured at said second open end, said first and second lid securing members having an opening for receiving respective first and second lids, and configured for rotatably frictionally engaging said first and second lids for closing the openings thereof;

first and second lids configured for being frictionally engaged with said first and second lid securing members;

at least one speaker secured as part of at least one of said first and second lids;

a power source for said at least one speaker; and a connection arranged for having an audio signal source connected thereto for connection to the speaker.

8. The portable box according to claim 7, wherein said at least one speaker comprises two speakers, each speaker secured as part of a respective one of said first and second lids.

9. The portable box according to claim 7, further comprising rigid caps at ends of said first and second sleeves, said rigid caps having openings for allowing sliding engagement between said first and second sleeves and for providing sufficient friction for retaining said first and second sleeves in fixed position relative to each other at any point of sliding engagement.

10. The portable box according to claim 9, wherein said rigid caps are made of plastic material.

11. The portable box according to claim 10, wherein said plastic material is polypropylene.

12. The portable box according to claim 7, wherein said first and second sleeves are made to be water resistant.

13. The portable box according to claim 12, wherein said first and second sleeves are made of cellulosic material having water resistant coating thereon.

14. The portable box according to claim 7, wherein said first and second speakers are secured on said first and second lids, and said first and second lids have stand members for allowing said first and second lids to be arranged in an upright position.

15. The portable box according to claim 7, wherein said first and second lid securing members are said first and second lids are made of plastic material.

16. The portable box according to claim 15, wherein said plastic material is polypropylene.

17. The portable box according to claim 7, wherein said first and second sleeves are made of cellulosic material having water resistant coating thereon.

18. The portable box according to claim 7, wherein said first and second lid securing members have cutout regions and tabs adjacent the cutout regions, and said first and second lids have tabs for being received in said cutout regions and retained on said first and second lid securing members through rotation thereof to have said lid tabs received under said lid securing member tabs in a recess defined under the lid securing member tab.

19. The portable box according to claim 18, further comprising a projection in a wall of said recesses, and a cutout in said lid tab for engaging with said projection in the wall of said recesses for being engaged by said projection for securely retaining said first and second lids respectively on said first and second lid securing members.

20. The portable box according to claim 7, wherein said first and second lid securing members and said first and second lids are made of foamed plastic.

21. The portable box according to claim 7, wherein said first and second lid securing members are said first and second lids are made of cellular plastic.

22. The portable box according to claim 7, wherein said first and second lid securing members are configured for being rotated in two different directions for opening and closing.

23. The portable box according to claim 7, wherein said variable length conduit can be contracted in length to expose portions of contents therein for easy loading and unloading from the box.

* * * * *